US010378126B2

(12) United States Patent
Griesshammer et al.

(10) Patent No.: US 10,378,126 B2
(45) Date of Patent: Aug. 13, 2019

(54) SPINNING PREPARATION MACHINE

(71) Applicant: Maschinenfabrik Rieter AG, Winterthur (CH)

(72) Inventors: Christian Griesshammer, Winterthur (CH); Petr Haska, Ceska Trebova (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 15/313,430

(22) PCT Filed: May 7, 2015

(86) PCT No.: PCT/IB2015/000646
§ 371 (c)(1),
(2) Date: Nov. 22, 2016

(87) PCT Pub. No.: WO2015/181597
PCT Pub. Date: Dec. 3, 2015

(65) Prior Publication Data

US 2017/0096753 A1 Apr. 6, 2017

(30) Foreign Application Priority Data

May 26, 2014 (CH) ..... 00798/14

(51) Int. Cl.
*D01H 7/92* (2006.01)
*D01G 15/46* (2006.01)
*D01H 5/18* (2006.01)

(52) U.S. Cl.
CPC ..... *D01H 7/92* (2013.01); *D01G 15/46* (2013.01); *D01H 5/18* (2013.01)

(58) Field of Classification Search
CPC ..... D01H 7/92; D01H 7/923; D01H 7/26; D01G 15/46; A01H 5/18; A01H 5/22; A01H 5/28; A01H 5/58; A01H 5/72
(Continued)

(56) References Cited

U.S. PATENT DOCUMENTS 2,091,153 A * 8/1937 Martin ..... D01H 5/72 19/157
2,256,436 A * 9/1941 Kruse ..... D01H 7/923 57/293

(Continued)

FOREIGN PATENT DOCUMENTS

DE 24 47 715 A1 4/1976
DE 39 08 462 A1 2/1990

(Continued)

OTHER PUBLICATIONS

Swiss Search Report, dated Oct. 28, 2014.
PCT Search Report, dated Sep. 2, 2015.

*Primary Examiner* — Shaun R Hurley
*Assistant Examiner* — Bao-Thieu L Nguyen
(74) *Attorney, Agent, or Firm* — Dority & Manning, P.A.

(57) ABSTRACT

A spinning preparation machine includes a consolidating means for producing a roving having a protective twist from a fiber bundle, a drafting system arranged upstream of the consolidating means, a winding device arranged downstream of the consolidating means, and a movably mounted traversing element adjacent the winding device to guide the roving being wound onto a tube. In a side view of the spinning preparation machine, the consolidating means is arranged vertically between at least one feed roller of the drafting system and the traversing element, and the feed roller and the traversing element are arranged on a same side of the consolidating means so that in operation of the spinning preparation machine, the roving experiences a change in direction after exiting the consolidating means and prior to being wound onto the tube.

11 Claims, 2 Drawing Sheets

(58) Field of Classification Search
USPC ..... 19/293
See application file for complete search history.

(56) References Cited

U.S. PATENT DOCUMENTS

| | | | | | |
|---|---|---|---|---|---|
| 2,515,299 | A * | 7/1950 | Foster | D01H 7/923 | 28/271 |
| 2,602,195 | A * | 7/1952 | Liebowitz | D01H 5/18 | 19/248 |
| 3,312,050 | A * | 4/1967 | Noguera | D01H 13/04 | 57/315 |
| 3,589,119 | A * | 6/1971 | Braun | D01H 5/72 | 57/331 |
| 4,028,874 | A | 6/1977 | Maag et al. | | |
| 4,398,320 | A * | 8/1983 | Kubota | D01H 5/22 | 19/236 |
| 4,434,612 | A * | 3/1984 | Petracchi | D01H 7/923 | 57/331 |
| 4,488,397 | A * | 12/1984 | Venot | D01H 5/72 | 57/287 |
| 4,543,776 | A * | 10/1985 | Seiki | D01H 15/002 | 57/261 |
| 5,325,658 | A * | 7/1994 | Stahlecker | D01H 5/005 | 57/328 |
| 5,347,804 | A * | 9/1994 | Stahlecker | D01H 5/005 | 57/281 |
| 5,724,800 | A * | 3/1998 | Lucca | D01H 1/025 | 57/200 |
| 6,032,451 | A * | 3/2000 | Dinkelmann | D01H 1/025 | 57/315 |
| 6,035,621 | A * | 3/2000 | Scheerer | D01H 1/115 | 57/224 |
| 6,202,398 | B1 * | 3/2001 | Dinkelmann | D01H 1/08 | 19/246 |
| 6,349,530 | B1 * | 2/2002 | Stahlecker | B65H 63/006 | 57/264 |
| 6,666,011 | B2 * | 12/2003 | Gnos | D01H 5/72 | 57/315 |
| 7,647,760 | B2 * | 1/2010 | Griesshammer | D01H 5/42 | 57/209 |
| 7,661,259 | B2 | 2/2010 | Griesshammer et al. | | |
| 8,549,830 | B1 * | 10/2013 | Tao | D01H 7/92 | 57/336 |
| 8,607,540 | B2 * | 12/2013 | Betz | D01H 4/02 | 57/350 |
| 9,580,842 | B2 * | 2/2017 | Ke | D02G 1/02 | |
| 2015/0082766 | A1 | 3/2015 | Stahlecker et al. | | |

FOREIGN PATENT DOCUMENTS

| | | | |
|---|---|---|---|
| DE | 10 2012 102695 | A1 | 10/2013 |
| EP | 0 375 242 | A2 | 6/1990 |
| EP | 2 657 380 | A2 | 10/2013 |
| EP | 2 674 379 | A2 | 12/2013 |
| JP | S 55 26053 | U | 2/1980 |
| JP | S 55 26237 | A | 2/1980 |
| JP | S 55 30798 | U | 2/1980 |
| JP | S 55 152822 | A | 11/1980 |
| WO | WO 2005/026421 | A1 | 3/2005 |
| WO | WO 2009/086646 | A1 | 7/2009 |

* cited by examiner

SPINNING PREPARATION MACHINE

FIELD OF THE INVENTION

The present invention relates to a spinning preparation machine having at least one consolidating means for producing a roving that has a protective twist and that is made of a fiber bundle supplied to the consolidating means, a drafting system that is arranged upstream of the consolidating means in a running direction of the roving for drafting the fiber bundle before the latter enters the consolidating means, a winding device that is arranged downstream of the consolidating means in the running direction for winding the roving onto a tube, and a movably mounted traversing element arranged in the region of the winding device for guiding the roving while the latter is being wound onto the tube.

BACKGROUND

Generic spinning preparation machines are known in the prior art and are used for producing so-called roving. Roving is produced from slivers which are in most cases pretreated (for example doubled) by means of drafting and serves as a feed for the subsequent spinning process, in which the individual fibers of the roving are spun, for example by means of a ring spinning machine, to form a yarn. In order to give the roving the strength necessary for the further processing, it has proven to be advantageous, during production of the roving, to draft the supplied fiber bundle by means of a drafting system, which is usually part of the spinning preparation machine in question, and then to provide it with a protective twist. Said strength is important in order to prevent breaking of the roving during the winding onto a tube and/or during the feeding thereof to the downstream spinning machine. The applied protective twist must on the one hand be strong enough that a cohesion of the individual fibers during the individual winding and unwinding processes and corresponding transport processes between the respective types of machine is ensured. On the other hand, it must also be ensured that, despite the protective twist, the roving can be further processed in a spinning machine—the roving must therefore still be able to be drafted.

For producing such a roving, in the past so-called flyers were used, the delivery speed of which is nevertheless limited due to centrifugal forces that occur. There have therefore already been many proposals to avoid the flyers or to replace them with an alternative type of machine.

In this connection, it has also already been proposed, inter alia, to produce roving by means of air-jet spinning machines, in which the protective twist is created by means of swirled air flows. The basic principle here consists in guiding a fiber bundle through a consolidating means designed as an air spinning nozzle, in which an air vortex is generated. The latter finally effects that some of the outer fibers of the supplied fiber bundle are wrapped as so-called wrapping fibers around the centrally running fiber strand, which in turn consists of core fibers running substantially parallel to one another.

Another method for roving production is disclosed in DE 24 47 715 A1. The consolidation of the unconsolidated fiber bundle described therein takes place by a consolidating means brings about not a twisting, but rather a helical wrapping of a sliver with one or more filament yarns, preferably monofilament yarns, which hold the fiber bundle together and give it its strength. The spirals of the individual filament yarns may in this case be arranged in the same direction or in opposite directions. Preference is given to two filament yarns which are arranged in opposite directions of rotation and in a manner crossing over one another. The roving produced in this way is thus composed essentially of a sliver of parallel staple fibers and one or more fine-titer filament yarns wrapping helically around the sliver.

There are various possibilities for wrapping the filament yarn or filament yarns around the unconsolidated fiber bundle. For example, the filament yarn can be applied onto small bobbins of small diameter. The filament yarn is then drawn off from the stationary bobbin and drawn through the bobbin axis together with the fiber bundle, whereby the filament yarn is wrapped around the fiber bundle and the number of windings drawn off from the bobbin corresponds to the number of wraparounds applied to the fiber bundle. In principle, it is also possible to design the consolidating means in such a way that only the unconsolidated fiber bundle is guided through the bobbin axis, so as to hereby relocate the winding process to behind the filament yarn bobbin. The wrapping point should in this case be defined by a suitable thread guide.

Another method for producing roving is described in WO 2009/086646 A1, wherein the method comprises the following steps: 1) providing a fiber bundle in the form of two, preferably untwisted, slivers, 2) applying S and Z twists over alternating regions of the two slivers, wherein regions of S and Z twists on the respective sliver are separated by regions without any twist, 3) bringing together the two slivers provided with S and Z twists to form a roving, wherein the two slivers automatically twist together on account of their tendency to twist back.

The S and Z twists may be created for example by means of two elements of the consolidating means, which hold the respective sliver in a clamped manner, wherein at least one element, preferably both elements, apply opposite twists on the sliver in an alternating manner on both sides by a relative movement on the surface thereof transversely to the longitudinal direction of the sliver. At the same time, the respective sliver is moved in the sliver direction. However, the S and Z twists can also be created by means of an aerodynamic, in particular pneumatic, method.

The alternating S and Z twists are moreover interrupted by intermediate regions without any twist. The two slivers provided with S and Z twists in the same way are finally brought together at the so-called joining point. Here, the slivers start to twist together automatically, that is to say they wind around each other. This so-called double-folding maintains the S and Z twists in the individual slivers, so that a self-stabilizing two-component roving is obtained. In principle, however, care should be taken here to ensure that the regions without any twist in the first sliver should be arranged offset in the longitudinal direction relative to the regions without any twist in the second sliver, so that two regions without any twist in the first and second sliver never lie next to one another in the resulting roving, since the strength of the roving depends substantially on the phase position of the regions without any twist in the two slivers. As described above, the rovings are therefore always brought together by the consolidating means in such a way that their regions without any twist lie out of phase. The roving produced in this way ultimately has a greater strength than an untwisted fiber bundle, said strength ultimately being sufficient to wind the roving onto a bobbin and unwind it again from the latter without false drafts.

In general there is always the need with the associated spinning preparation machines to keep the space required to a minimum, but the spinning preparation machines must also still be easily accessible so that in particular it is possible to perform maintenance and adjustments and clear any errors after an undesired stop in the production of roving.

SUMMARY OF THE INVENTION

An object of the present invention is therefore to suggest a spinning preparation machine that is distinguished in this regard from the known prior art in a positive manner. Additional objects and advantages of the invention will be set forth in part in the following description, or may be obvious from the description, or may be learned through practice of the invention.

The objects are attained using a spinning preparation machine having the features described and claimed herein.

In accordance with the invention, the spinning preparation machine is characterized in that the consolidating means, which is preferably embodied as an air spinning nozzle and works using the aforesaid air spinning method, in a side view of the spinning preparation machine, is arranged vertically between at least one feed roller of the drafting system and the traversing element mounted vertically therebelow. Thus, in the side view, the consolidating means is placed between the feed roller, preferably between all of the rollers in the drafting system, and the traversing element (wherein the traversing element is embodied for guiding the roving in a traversing back and forth movement or up and down movement when winding the roving onto a tube). It is furthermore provided that the feed roller and the traversing element, in the aforesaid side view, are arranged on the same side of the consolidating means. Because of this, when the spinning preparation machine is operating, the roving experiences a change in direction after exiting the consolidating means and prior to being wound onto the tube. The consolidating means may for instance be placed in a front region, which may be accessed from the front, of a workstation of the spinning preparation machine (wherein the workstation comprises at least a drafting system, a consolidating means, a traversing element, and a winding device), while the feed roller of the drafting system and the traversing element, seen from the front, are arranged behind the consolidating means. In this case the workstation has a relatively small footprint since the aforesaid elements of the workstation are arranged above one another.

If the spinning preparation machine comprises a plurality of workstations, arranged for instance side by side, it is also advantageous when all of the workstations are embodied according to the description in the foregoing and in the following.

At this point it should also be pointed out in general that the consolidating means may be designed in various ways. For example, it would be conceivable that the consolidating means is suitable for producing the roving in the manner described in the abovementioned documents WO 2009/086646 A1 and DE 24 47 715 A1.

Preferably, however, the spinning preparation machine is designed as an air-jet spinning machine and the consolidating means is designed as an air spinning nozzle, by means of which the protective twist in the roving is created, as described above, by means of swirled air flows (part of such a spinning preparation machine designed as an air-jet spinning machine is described by way of example in the description of the figures).

In any case, it is advantageous when the spinning preparation machine has a pair of draw-off rollers arranged downstream of the consolidating means in the running direction. The pair of draw-off rollers comprises two draw-off rollers, of which at least one may be caused to rotate by means of a drive. When the spinning preparation machine is operating, the roving is guided in a clamped manner between the two adjacently arranged and rotating draw-off rollers and actively pulled out of the consolidating means by the rotation of the draw-off rollers. In this context, it is advantageous when the pair of draw-off rollers, in the side view of the spinning preparation machine, is arranged vertically between at least the feed roller of the drafting system and the traversing element mounted vertically therebelow. In the side view, the feed roller and the traversing element are preferably arranged on the same side of the pair of draw-off rollers, wherein when the spinning preparation machine is operating, the roving experiences a change in direction that may be effected by the pair of draw-off rollers. Likewise, the change in direction may also be caused in that after passing through the draw-off rollers, the roving is wound by a winding device that is disposed horizontally on the same side as the drafting system. Finally, it can be advantageous when the consolidating means, the drafting system, and the traversing element, in a front view of the workstation, are arranged at least in part behind the pair of draw-off rollers (or one draw-off roller of the pair). In this case, the pair of draw-off rollers may be accessed rapidly and simply from the front so as to remove any fiber windings present.

It is also advantageous when the spinning preparation machine comprises a tube transfer device that transfers tubes from a tube transport device to the winding device and/or vice versa. The tube transfer device may for instance comprise a tube gripper that is connected to a controller for the spinning preparation machine and that is embodied to move, preferably to lift, a loaded tube from the winding device onto a conveyor and an empty tube from a conveyor into or onto the winding device. The traversing element, in the aforesaid side view, is preferably arranged horizontally between the consolidating means and the tube transfer device. While the consolidating means should be disposed in a front region that is accessible from the front, it has proved useful to place the tube transfer device on a side of the workstation that faces away from the front region, preferably in its rear region, so that the loaded tubes may be released "to the rear" (i.e. may be released in a direction away from the consolidating means). There, they may be transferred to a conveyor belt for a tube transport device and transported to a predetermined location.

It is extremely advantageous when the winding device comprises at least one tube receiver for fixing of one or a plurality of tubes, for instance in a positive or non-positive fit. The tube receiver, which is embodied for instance as a rotatable platform, is preferably arranged, in the side view, in the horizontal direction between the tube transfer device and the traversing element. In this case, the roving is wound onto the tube on one side, wherein the tube transfer device is preferably disposed on a second side of the tube receiver facing away from this side. It may also be advantageous when the tube receiver is arranged between the tube transfer device and the consolidating means and/or between the tube transfer device and the pair of draw-off rollers.

It is likewise advantageous when the tube receiver of the winding device and/or the tube transfer device, in the side view, are arranged below the consolidating means. In this case, the consolidating means is disposed in a position that is easily accessible by a user, wherein the drafting system or the individual rollers thereof may be arranged above the consolidating means to make them easily accessible, as well.

In any case, the roving should move downward or on a downward incline, at least in certain segments, between the consolidating means and the traversing element or the winding device in order to keep the forces acting on the roving in this segment as low as possible and thus to minimize the risk of breaking the roving.

It is particularly advantageous when the tube receiver, the traversing element, the consolidating means, and preferably also the aforesaid feed roller of the drafting system are arranged, in the aforesaid side view, on the same side of the tube transfer device. The tube transfer device may be disposed for instance on the side of the traversing element that faces away from the consolidating means and may be arranged in the region of a back side of the specific workstation of the spinning preparation machine, wherein the back side is disposed opposing the front side of the spinning preparation machine arranged in the region of the consolidating means.

It is advantageous when a guide for guiding the fiber bundle is arranged upstream of the drafting system in a transport direction thereof. The guide for the fiber bundle preferably comprises a track on which the fiber bundle is placed and thus is supported vertically. For instance, it would be possible to form the track using an elongate profile, consisting for instance of metal or plastic, that extends horizontally or in a direction slightly inclined from the horizontal between a feed segment and a delivery segment of the guide. The feed and delivery segments preferably each form an end segment of the guide, wherein the feed segment should be arranged in the region of a container (preferably thereabove) holding the fiber bundle and the delivery segment should be arranged in the vicinity of the drafting system. In particular the delivery segment should be disposed in the immediate vicinity of a feed roller for the drafting system in order to enable a nearly seamless transition between guide and drafting system. In general, it is also advantageous when the feed segment is placed higher than the delivery segment so that the guide forms a chute for the fiber bundle.

It is also advantageous when the tube transport device comprises at least one conveyor (e.g. in the form of a conveyor belt) for transporting empty tubes and/or tubes loaded with a roving, wherein the conveyor(s), seen in a top view of the spinning preparation machine, are arranged at least in part between the feed segment of the guide for the fiber bundle and the drafting system.

The conveyor(s) of the tube transport device that are fixed, for example, on a shop floor of a shop accommodating the spinning preparation machine may comprise for instance a plurality of tube holders that each receive an empty tube or a tube loaded by means of the spinning preparation machine. The tube holders are movable for instance by moving the conveyor(s) between the spinning preparation machine and one or a plurality of collecting points for the empty or loaded tubes so that the spinning preparation machine may always be supplied with empty tubes and the loaded tubes may be removed from the spinning preparation machine.

As seen in a top view of the spinning preparation machine, the aforesaid tubes are guided between the feed segment and the drafting system so that the space available between feed segment and drafting system may be used advantageously for placing some of the conveyor(s).

It is also advantageous when the drafting system, the winding device, the tube transfer device, and the guide are arranged, in a front view of the spinning preparation machine, at least in part behind the consolidating means. In particular, all of the aforesaid units are easily accessible from the front when they are disposed behind the consolidating means. Fiber residues located in the consolidating means may be easily removed from the consolidating means after an unintentional interruption in the production of rovings. It is furthermore an advantage when, in the front view, the conveyor(s) runs or run behind the consolidating means, the winding device, and the tube transfer device so that this/these conveyor(s) is/are accessible from behind.

It is also extremely advantageous when the traversing element, the winding device, and the tube transfer device have at least one common horizontal sectional plane. The elements are thus preferably placed adjacent to one another and may be fixed on a common platform.

It is also advantageous when the feed roller of the drafting system and the consolidating means have a common sectional plane that, in the side view of the side of the consolidating means facing away from the winding device, intersects the sectional plane mentioned in the previous paragraph. In this case, the transport direction of the drafting system is oriented on a downward incline towards the front side of the spinning preparation machine.

In this context, it is advantageous when the sectional planes form an angle $\alpha$ that ranges between 85° and 20°, preferably between 80° and 30°. In this case, the transport direction of the drafting system is downwardly inclined so that the roving is output to the consolidating means on a downward incline relative to the drafting system.

BRIEF DESCRIPTION OF THE DRAWINGS

Further advantages of the invention are described in the following exemplary embodiments, in which.

DETAILED DESCRIPTION

Figure 1:
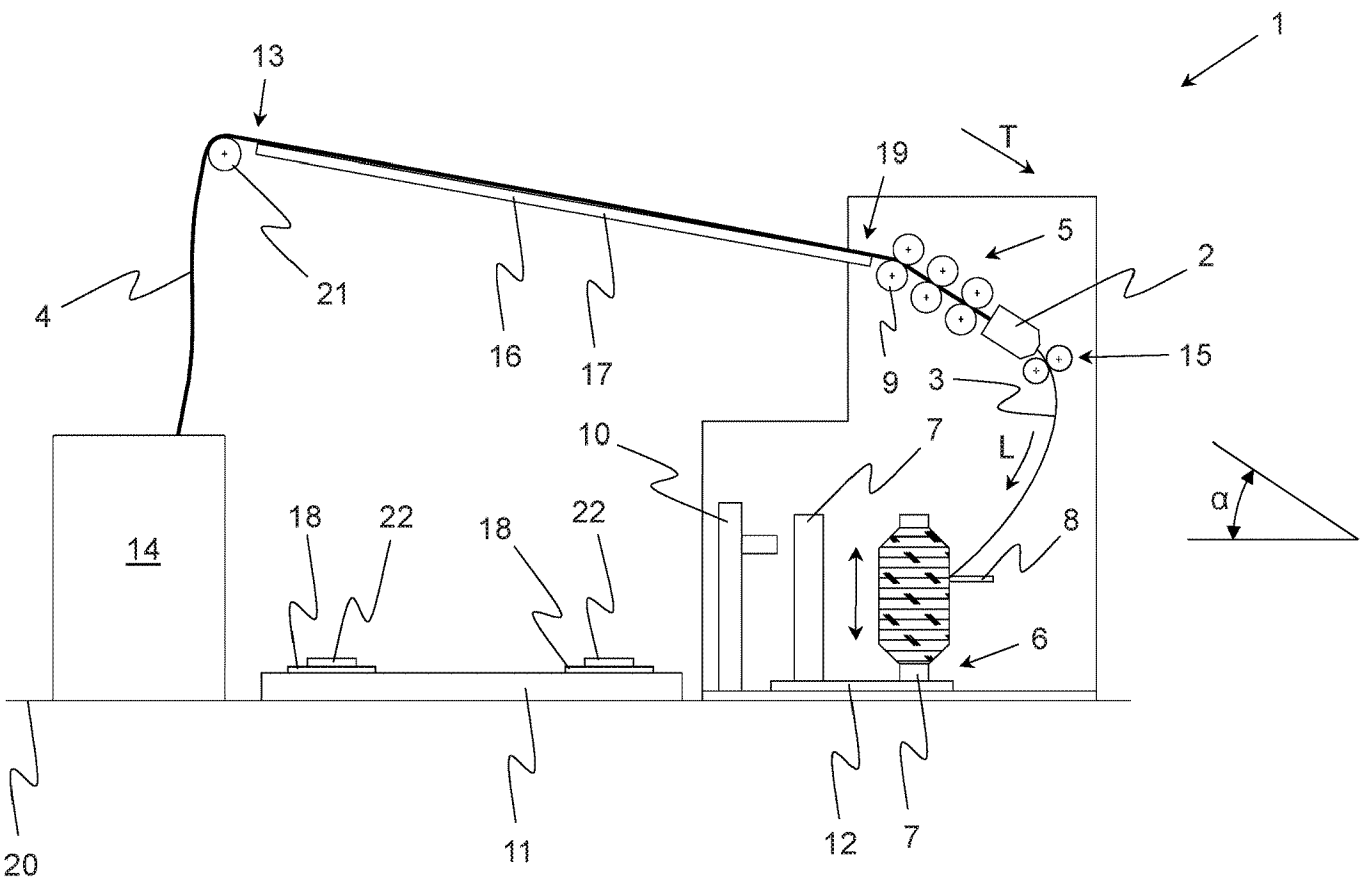
FIG. 1 is a side view of a spinning preparation machine according to the invention, and, FIG. 2 is a top view of a spinning preparation machine according to the invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
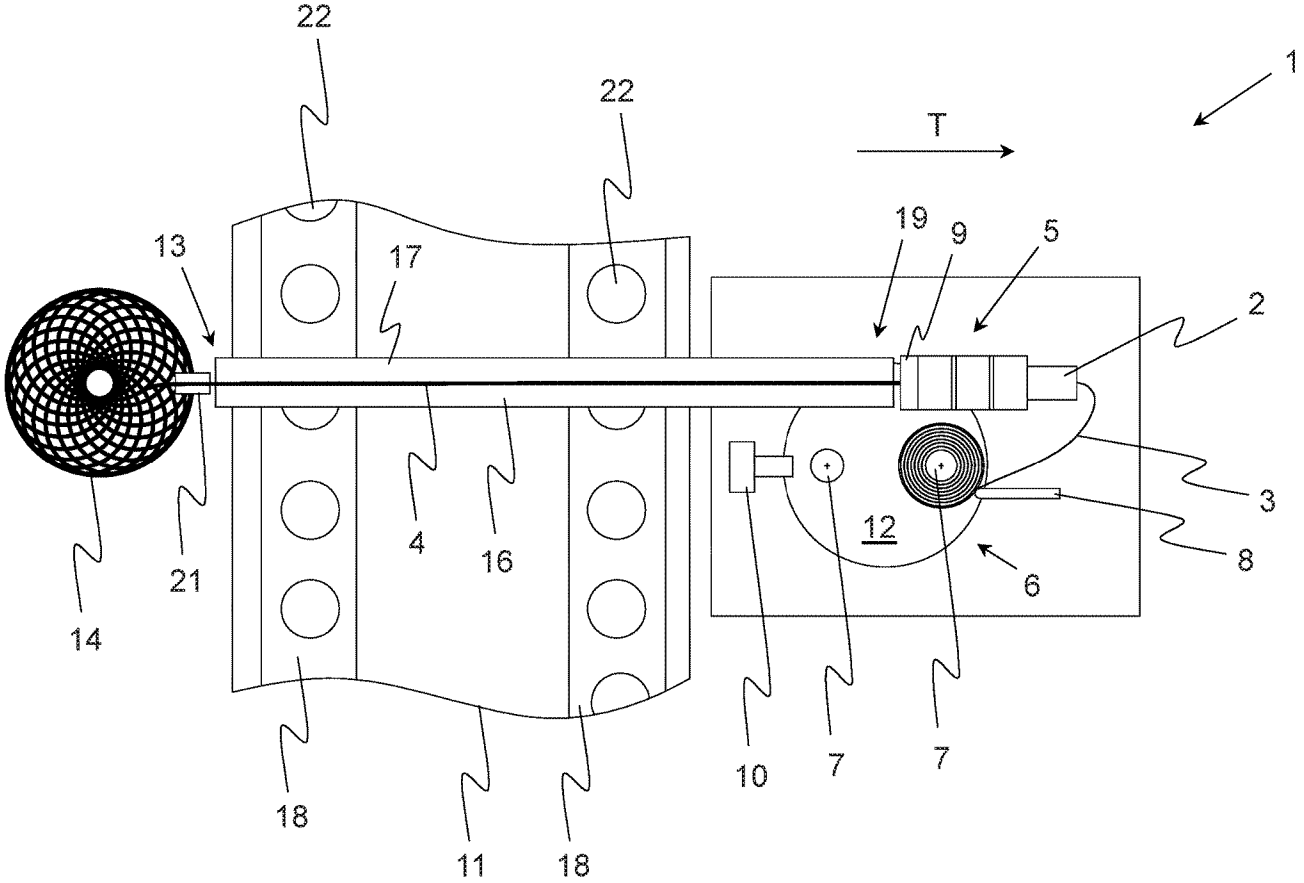

FIG. 1 is a schematic side view of a spinning preparation machine 1 according to the invention in the form of an air-jet spinning machine that stands on a shop floor 20 and produces roving 3 (FIG. 2). The spinning preparation machine 1 preferably comprises a drafting system 5 with a plurality of corresponding drafting system rollers (only one of the two feed rollers 9 arranged in the input area of the drafting system 5 is provided with a reference number) that is supplied with a fiber bundle 4, for instance in the form of a doubled drafter sliver.

The fiber bundle 4 generally originates from a container 14 (e.g. a sliver can) and may be fed to the drafting system 5, preferably after passing over a guide roller 21, via a guide 16, wherein the guide 16 may be embodied for instance as a longitudinal profile. In principle, the guide 16 comprises a feed segment 13 adjacent to the container 14, a delivery segment 19 adjacent to the drafting system 5, and a guide segment 17 disposed therebetween for supporting the fiber bundle 4 at least from below.

The illustrated spinning preparation machine 1 furthermore also comprises a consolidating means, spaced apart from the drafting system 5, in the form of an air spinning nozzle 2 having an internal vortex chamber (known from prior art and therefore not shown) and a yarn-forming element (likewise known from the prior art and therefore not shown) in the form of a hollow spindle that projects into the vortex chamber. In the vortex chamber, the fiber bundle 4 or at least a portion of the fibers in the fiber bundle 4 are provided with a protective twist by means of a swirled air flow generated by air nozzles in the vortex chamber.

The air spinning machine may furthermore comprise a pair of draw-off rollers 15 for the roving 3 downstream of the drafting system 5 in the illustrated transport direction T (the draw-off unit is not absolutely necessary and is also shown only in FIG. 1 for reasons of clarity). Moreover, a winding device 6 is present that preferably serves for receiving at least two tubes 7 and with which it is possible to wind the roving 3 onto a tube 7, the roving 3 being guided by means of a traversing element 8 that can be moved back and forth in the direction of the double arrow shown in FIG. 1. The winding device 6 may in particular comprise a tube receiver 12 (e.g. in the form of a platform) that can be rotated by means of a drive and on which the tubes 7 may be fixed via corresponding holding devices (not shown in greater detail), wherein the holding devices and thus also the respective tubes 7 may be caused to rotate, preferably via separate drives.

The spinning preparation machine 1 works according to a special air spinning method. For forming the roving 3, the fiber bundle 4 is guided in the transport direction T via an inlet opening (not shown) into the vortex chamber of the air spinning nozzle 2. There, it is given a protective twist, that is to say at least a portion of the fibers of the fiber bundle 4 is grasped by the swirled air flow, which is created by suitably placed spinning air channels. A portion of the fibers is thereby pulled at least a little way out of the fiber bundle 4 and is wound around the tip of the yarn forming element which protrudes into the vortex chamber.

Finally, the fibers of the fiber bundle 4 are drawn out of the vortex chamber via an inlet opening of the yarn forming element and a draw-off channel which is arranged inside the yarn forming element and adjoins the inlet opening. In doing so, the free fiber ends are finally also drawn on a helical trajectory in the direction of the inlet opening and wrap as wrapping fibers around the centrally running core fibers, resulting in a roving 3 which has the desired protective twist.

Due to the only partial twisting of the fibers, the roving 3 has a draftability that is essential for the further processing of the roving 3 in a downstream spinning machine, for example a ring spinning machine. Conventional air-jet spinning devices, on the other hand, give the fiber bundle 4 such a pronounced twist that the required drafting following yarn production is no longer possible. This is also desired in this case since conventional air-jet spinning machines 1 are designed to produce a finished yarn, which is generally intended to be characterized by a high strength.

As explained in the foregoing, after leaving the air spinning nozzle 2, the roving 3 is wound onto a tube 7 by means of the winding device 6. If the specific tube 7 is adequately loaded with roving 3, it is exchanged for an empty tube 7, wherein the aforesaid tube pick-up 12 is rotated for this purpose about a preferably vertical rotational axis until the empty tube 7 shown in FIG. 1 is disposed in the position of the loaded tube 7 shown in FIG. 1 and vice versa.

While the empty tube 7 is being loaded with roving 3 following this tube exchange, a tube transfer device 10 is activated that transfers the loaded tube 7 to a conveyor 18 (for instance in the form of a conveyor belt) of a tube transport device 11 that finally transports the tube 7 to a removal location (not shown). This conveyor 18, a plurality of which may be present, preferably comprises a plurality of tube holders 22 by which the tubes 7 may be held during their transport. Once the loaded tube 7 has been transported away, the position on the tube pick-up 12 of the winding device 6 that has been freed up by this may be occupied by a new, empty tube 7, the tube transfer device 10 preferably accomplishing this.

Alternatively, it would also naturally be possible to eliminate the tube transfer device 10. Likewise, the winding device 6 could also have only one holding device for one tube 7. Ultimately, the illustrated guide 16 also does not necessarily have to be present, wherein in this case for instance the fiber bundle 4 may be inserted into the drafting system 5 immediately after it has left the container 14 (possibly after first going through a guide roller 21). It is also not absolutely necessary for the tube transport device 11 to be present.

In accordance with the invention, it is suggested that the air spinning nozzle 2, in a side view of the spinning preparation machine 1 (which is preferably embodied as an air-jet spinning machine) is arranged vertically between at least one feed roller 9 of the drafting system 5 and the traversing element 8 mounted vertically therebelow. It is furthermore provided that the feed roller 9 and the traversing element 8 are arranged, in the side view, on the same side of the air spinning nozzle 2 so that when the spinning preparation machine 1 is operating, the roving 3 experiences a change in direction after leaving the air spinning nozzle 2 and prior to being wound onto the tube 7.

In particular, the feed roller 9 of the drafting system 5 should have a common sectional plane with the air spinning nozzle 2, which sectional plane with the horizontal forms an angle $\alpha$ that is between 20° and 85° so that the transport direction of the drafting system 5 runs on a downward incline. In this case it is also ensured that the running direction L of the roving 3 is oriented downward, at least in segments, between the traversing element 8 and the air spinning nozzle 2 (or the pair of draw-off rollers 15) so that the forces acting on the roving 3 in this region are particularly low.

As may be seen from the figures, the winding device 6, the tube transfer device 10, and the traversing element 8 may be placed adjacent to one another and below the air spinning nozzle 2 and the drafting system 5.

If a tube transport device 11 with corresponding conveyor(s) 18 is present, it is advantageous when the latter are arranged, at least in part, in a top view of the spinning preparation machine 1 shown in FIG. 2, between the feed segment 13 of the guide 16 and the drafting system 5. In particular, the conveyor(s) 18 should be supported in the area of the so-called shop floor 20 so that it/they, in the side view of the spinning preparation machine 1 shown in FIG. 1, is/are disposed below the guide 16.

In addition, it is advantageous when the conveyor(s) 18 is/are arranged between the feed segment 13 of the guide 16 or the container 14 and the delivery segment 19 of the guide 16, the guide 16 spanning the conveyor(s) 18 in a bridge-like manner. The fiber bundle 4 is now guided from behind via the conveyor(s) 18 and finally travels in the front region of the spinning preparation machine 1 into the drafting system 5 and ultimately into the air spinning nozzle 2.

As FIG. 2 shows, the winding device 6, the traversing element 8, and the tube transfer device 10 may be arranged to the side of the drafting system 5 or air spinning nozzle 2. In this case, the result is a particularly space-saving arrangement of the individual elements.

Furthermore, the drafting system 5, the air spinning nozzle 2, and also the guide 16 should be placed above the winding device 6, the traversing element 8, the tube transfer device 10, and/or the conveyor(s) 18 to utilize the free space above the aforesaid elements.

Finally, the above description is referenced with respect to the possible mutual arrangements of the individual segments (feed segment 13, guide segment 17, delivery segment 19, drafting system 5, air spinning nozzle 2, traversing element 8, winding device 6, tube transfer device 10, conveyor(s) 18) so that the mutual arrangement depicted in the FIGS. 1 and 2 shall be construed only as an example.

The present invention is not limited to the exemplary embodiments that have been shown and described. Modifications within the scope of the patent claims are also possible, as is any combination of the described features, even if they are shown and described in different parts of the description or the claims or in different exemplary embodiments.

REFERENCE LIST

1 Spinning preparation machine
2 Air spinning nozzle
3 Roving
4 Fiber bundle
5 Drafting system
6 Winding device
7 Tube
8 Traversing element
9 Feed roller of the drafting system
10 Tube transfer device
11 Tube transport device
12 Tube receiver
13 Feed segment
14 Container
15 Pair of draw-off rollers
16 Guide
17 Guide segment
18 Conveyor
19 Delivery segment
20 Shop floor
21 Guide roller
22 Tube holder
α Angle between the common horizontal sectional plane of traversing element, winding device, and tube transfer device and the common section plane of feed roller or the drafting system and spinning nozzle
L Running direction of the roving
T Transport direction of the drafting system

The invention claimed is:

1. A spinning preparation machine, comprising:

a consolidating means for producing a roving having a protective twist from a fiber bundle supplied to the consolidating means;

a drafting system arranged upstream of the consolidating means in a running direction of the roving to draft the fiber bundle;

a winding device arranged downstream of the consolidating means in the running direction to wind the roving onto a tube;

a movably mounted traversing element adjacent the winding device to guide the roving being wound onto the tube;

in a side view of the spinning preparation machine, the consolidating means arranged vertically between at least one feed roller of the drafting system and the traversing element;

in the side view of the spinning preparation machine, the feed roller and the traversing element arranged on a same side of the consolidating means so that in operation of the spinning preparation machine, the roving experiences a change in direction after exiting the consolidating means and prior to being wound onto the tube; and a tube transfer device disposed to transfer the tubes from a tube transport device to the winding device or from the winding device to the tube transport device, wherein the traversing element, in the side view, is arranged horizontally between the consolidating means and the tube transfer device.

2. The spinning preparation machine in accordance with claim 1, wherein the consolidating means comprises an air spinning nozzle, and wherein the roving having the protective twist is produced inside the air spinning nozzle by means of a swirled air flow.

3. The spinning preparation machine in accordance with claim 1, further comprising a pair of draw-off rollers arranged downstream of the consolidating means in the running direction, the pair of draw-off rollers arranged vertically between the feed roller of the drafting system and the traversing element, wherein the roving experiences the change of direction through or downstream of the pair of draw-off rollers.

4. The spinning preparation machine in accordance with claim 1, wherein the winding device further comprises at least one tube receiver to fix the tube thereon, the tube receiver arranged, in the side view, horizontally between the tube transfer device and the traversing element, or between the tube transfer device and the consolidating means, or between the tube transfer device and the pair of draw-off rollers.

5. The spinning preparation machine in accordance with claim 4, wherein one or both of the tube receiver or the tube transfer device are arranged, in the side view, below the consolidating means.

6. The spinning preparation machine in accordance with claim 4, wherein the tube receiver, the traversing element, and the consolidating means are arranged, in the side view, below the tube transfer device.

7. The spinning preparation machine in accordance with claim 1, further comprising a guide for the fiber bundle arranged upstream of the drafting system in a transport direction of the drafting system, the guide comprising a feed segment at an end thereof opposite from the drafting system and a delivery segment at an end thereof adjacent the drafting system, and the feed segment arranged, in the side view, on a side of the tube transfer device facing away from the consolidating means.

8. The spinning preparation machine in accordance with claim 7, wherein the drafting system, the winding device, the tube transfer device, and the guide are arranged, in a front view of the spinning preparation machine, at least in part behind the consolidating means.

9. The spinning preparation machine in accordance with claim 1, wherein the traversing element, the winding device, and the tube transfer device have at least one common horizontal sectional plane.

10. The spinning preparation machine in accordance with claim 9, wherein the feed roller and the consolidating means have a common sectional plane that, in the side view, intersects the first horizontal sectional plane at a side of the consolidating means that faces away from the winding device.

11. The spinning preparation machine in accordance with claim 10, wherein the common horizontal sectional plane and the common sectional plane form an angle (a) that ranges between 85° and 20°.

* * * * *